US008010022B2

(12) United States Patent
Yamakawa

(10) Patent No.: US 8,010,022 B2
(45) Date of Patent: Aug. 30, 2011

(54) DEVELOPING ROLLER AND METHOD OF PRODUCING THE SAME, AND INSPECTION PROCESS FOR DEVELOPING ROLLER PRODUCT

(75) Inventor: Koji Yamakawa, Yokohama (JP)

(73) Assignee: Bridgestone Corporation, Tokyo (JP)

( * ) Notice: Subject to any disclaimer, the term of this patent is extended or adjusted under 35 U.S.C. 154(b) by 1035 days.

(21) Appl. No.: 11/730,647

(22) Filed: Apr. 3, 2007

(65) Prior Publication Data

US 2008/0013985 A1 Jan. 17, 2008

(30) Foreign Application Priority Data

Apr. 4, 2006 (JP) ..... 2006-103240

(51) Int. Cl.
*G03G 15/08* (2006.01)

(52) U.S. Cl. ..... 399/279; 399/119; 399/286

(58) Field of Classification Search ..... 399/119, 399/279, 286

See application file for complete search history.

(56) References Cited

U.S. PATENT DOCUMENTS 5,697,027 A * 12/1997 Takagi et al. ..... 399/279
2001/0001053 A1* 5/2001 Hanson et al. ..... 429/233

FOREIGN PATENT DOCUMENTS

CN 1489525 A 4/2004
JP 10-326039 A 12/1998
JP 2002-536513 A 10/2002
JP 2005-156856 A 6/2005

OTHER PUBLICATIONS

Society of Colour Material Ed. (Jan 20, 1993). Toryo yogo jiten (Dictionary of Paint Terms) 1st ed. Gihodo Shuppan Co. Ltd, 186.

* cited by examiner

*Primary Examiner* — David M Gray
*Assistant Examiner* — G. M. Hyder
(74) *Attorney, Agent, or Firm* — Sughrue Mion, PLLC

(57) ABSTRACT

A developing roller having a properly adjusted toner feed quantity comprises a shaft, an elastic layer and a surface covering layer, in which a JIS 10-point average roughness (Rz) of the surface is 4-7 μm and a specular gloss at 85° according to JIS Z8741 of the surface is 14-55.

6 Claims, 2 Drawing Sheets

DEVELOPING ROLLER AND METHOD OF PRODUCING THE SAME, AND INSPECTION PROCESS FOR DEVELOPING ROLLER PRODUCT

BACKGROUND OF THE INVENTION

1. Field of the Invention

This invention relates to a developing roller and a method of producing the same as well as a process for inspecting a developing roller, and more particularly to a developing roller controlling a scattering of toner feed quantity and capable of forming a good image and a method of producing the same.

2. Description of the Related Art

In the image forming apparatus of an electrophotographic system such as copier, printer or the like, there is known a pressurized developing method as a developing method wherein toners are fed to a photosensitive drum keeping a latent image and then the toners are adhered to the latent image on the photosensitive drum to visualize the latent image. In this pressurized developing method, the image development is carried out, for example, by charging a photosensitive drum to a constant potential, forming an electrostatic latent image on the photosensitive drum through an exposure equipment and contacting a developing roller carried with toners onto the photosensitive drum kept with the electrostatic latent image to adhere the toners to the latent image on the photosensitive drum.

In the pressurized developing method, since the developing roller should be rotated while surely holding a state of being attached firmly to the photosensitive drum, it has a structure of forming a semi-conductive elastic layer made from a semi-conductive elastomer, which is formed by dispersing carbon black or metal powder into an elastomer such as polyurethane, silicone rubber, acrylonitrile-butadiene rubber (NBR), ethylene-propylene-diene rubber (EPDM), epichlorohydrin rubber (ECO) or the like, or a foamed body thereof on an outer periphery of a shaft made from a good conductive material such as a metal or the like. Also, a surface covering layer may be further formed on the surface of the above elastic layer for the purpose of controlling the charging characteristics and adhesion property to toners and preventing the contamination of the photosensitive drum with the elastic layer, and the like.

In the developing roller having the above construction, it is generally required to optimize the toner feed quantity for forming a good image without causing image fault such as fog or the like. As to such a requirement, there has hitherto been known a method wherein the toner feed performance of the developing roller is improved by changing the surface roughness of the developing roller or changing the polishing method of the surface to adjust the surface form of the developing roller (see, for example, JP-A-2000-206779, JP-A-H08-123191 and JP-A-H08-286501).

However, there is a problem that even when the surface form of the developing roller is adjusted by the above method, the scattering of the toner feed quantity is caused by the resulting developing roller.

SUMMARY OF THE INVENTION

It is, therefore, an object of the invention to solve the above problem of the conventional technique and to provide a developing roller having a properly adjusted toner feed quantity. Also, it is another object of the invention to provide a method of producing such a developing roller. Further, it is the other object of the invention to provide a process for inspecting a developing roller product.

The inventor has made various studies in order to achieve the above objects and found that the toner feed quantity of a developing roller comprising an elastic layer and a surface covering layer formed on the elastic layer can be properly adjusted by defining JIS 10-point average roughness (Rz) and specular gloss at 85° according to JIS Z8741 of the surface within specified ranges, respectively, and as a result, the invention has been accomplished.

That is, the developing roller according to the invention is a developing roller comprising a shaft, an elastic layer formed on an outer periphery of the shaft, and a surface covering layer formed on an outer peripheral face of the elastic layer, characterized in that a JIS 10-point average roughness (Rz) of the surface is 4-7 μm and a specular gloss at 85° according to JIS Z8741 of the surface is 14-55.

In a preferable embodiment of the developing roller of the invention, the elastic layer is made from polyurethane.

In another preferable embodiment of the developing roller of the invention, the surface covering layer is made from a crosslinking resin.

In the other preferable embodiment of the developing roller of the invention, the crosslinking resin is a polyurethane resin.

In a further preferable embodiment of the developing roller of the invention, the surface covering layer is formed by preparing a paint inclusive of a component constituting the surface covering layer, leaving for not less than 24 hours and thereafter applying the paint onto the outer peripheral face of the elastic layer.

Also, the method of producing the developing roller according to the invention is characterized in that in the production of the above developing roller, a paint inclusive of a component constituting a surface covering layer is prepared and left to stand for not less than 24 hours and thereafter the paint is applied onto the outer peripheral face of the elastic layer.

Furthermore, the inspection method of the developing roller according to the invention is characterized in that the surface of the developing roller is confirmed to have a specular gloss at 85° according to JIS Z8741 (Gs(85°)) of 14-55.

The invention develops an advantageous effect capable of providing a developing roller having a properly adjusted toner feed quantity. Also, the invention develops an advantageous effect of providing the production method of the developing roller capable of properly adjusting the toner feed quantity.

DESCRIPTION OF THE PREFERRED EMBODIMENTS

Figure 1:
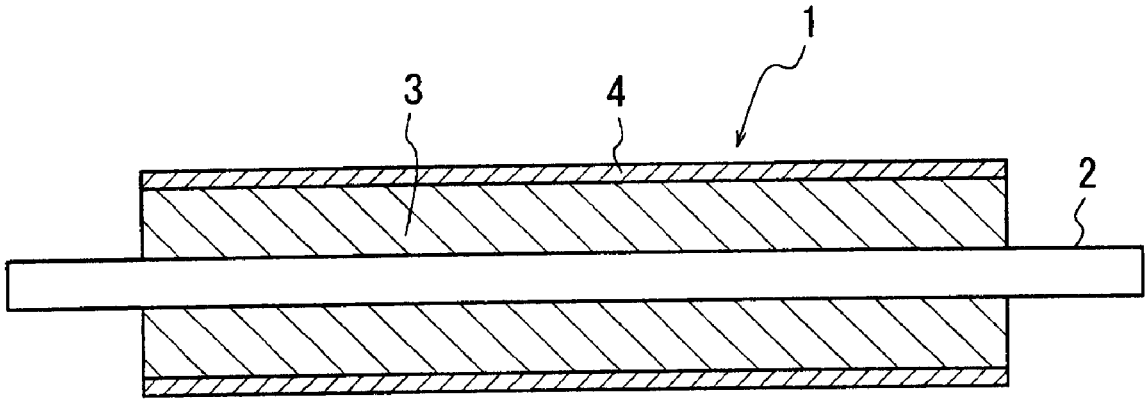
FIG. 1 is a section view of the developing roller according to an embodiment of the invention.

The developing roller according to the invention will be described in detail with reference to the accompanying drawings below. FIG. 1 is a section view of the developing roller according to an embodiment of the invention. The illustrated developing roller 1 comprises a shaft 2, an elastic layer 3 formed on the outer periphery of the shaft 2, and a surface covering layer 4 formed on the outer peripheral face of the elastic layer 3. Although the surface covering layer 4 in the figure is one layer, the surface covering layer 4 in the developing roller according to the invention may be two or more layers. In the developing roller according to the invention, the surface covering layer 4 is disposed on the outer peripheral face of the elastic layer 3, so that it can be sufficiently prevented to contaminate the photosensitive drum with contamination substances oozing from the elastic layer 3.

In the developing roller according to the invention, the surface is required to have a JIS 10-point average roughness (Rz) of 4-7 μm and a specular gloss at 85° according to JIS Z8741 (Gs(85°)) of 14-55. When the surface roughness and gloss of the developing roller are within the above ranges, the toner feed quantity can be adjusted to a proper range, whereby the occurrence of the image fault such as fog or the like can be suppressed.

The shaft 2 in the developing roller according to the invention is not particularly limited as far as it has a good electric conductivity, and there can be used a core of a solid body made of a metal such as iron, stainless steel, aluminum or the like, a hollow cylindrical shaft of a metal formed by boring an interior of a solid body, a shaft made of a good conductive plastic and the like.

The elastic layer 3 in the developing roller according to the invention is made from an elastomer and may contain another component such as a conductive agent or the like, if necessary. As the elastomer used in the elastic layer 3 are mentioned polyurethane, silicone rubber, ethylene-propylene-diene rubber (EPDM), acrylonitrile-butadiene rubber (NBR), natural rubber, styrene-butadiene rubber (SBR), butadiene rubber, isoprene rubber, polynorbornene rubber, butyl rubber, chloroprene rubber, acryl rubber, epichlorohydrin rubber (ECO), ethylene-vinyl acetate copolymer (EVA) and a mixture thereof. Among them, polyurethane is preferable. In the elastic layer 3, the above elastomer may be used as a non-foamed body, or may be used as a foamed body by chemically expanding the elastomer with a foaming agent or mechanically blowing air to expand the elastomer as in the polyurethane foam.

As the conductive agent used in the elastic layer 3 may be mentioned an electron conductive agent, an ion conductive agent and the like. As the electron conductive agent are mentioned conductive carbon such as Ketjen black, acetylene black or the like; carbon black for rubber such as SAF, ISAF, HAF, FEF, GPF, SRF, FT, MT or the like; carbon black for color (ink) subjected to an oxidation treatment or the like; thermally decomposed carbon black; natural graphite, artificial graphite; a metal oxide such as tin oxide doped with antimony, ITO, tin oxide, titanium oxide, zinc oxide or the like; a metal such as nickel, copper, silver, germanium or the like; a conductive polymer such as polyaniline, polypyrole, polyacetylene or the like; a conductive whisker such as carbon whisker, graphite whisker, titanium carbide whisker, conductive potassium titanate whisker, conductive barium titanate whisker, conductive titanium oxide whisker, conductive zinc oxide whisker or the like; and so on. The amount of the electron conductive agent compounded is preferably within a range of 0.5-50 parts by mass, more preferably 1-40 parts by mass based on 100 parts by mass of the elastomer.

As the ion conductive agent are mentioned an ammonium salt such as a perchlorate, a chlorate, a hydrochloride, a bromate, an iodate, a fluoroborate, a sulfate, an ethyl sulfate, a carboxyl ate or a sulfonate of tetraethyl ammonium, tetrabutyl ammonium, dodecyltrimethyl ammonium, hexadecyltrimethyl ammonium, benzyltrimethyl ammonium, modified-fatty acid dimethylethyl ammonium or the like; a perchlorate, a chlorate, a hydrochloride, a bromate, an iodate, a fluoroborate, a sulfate, a trifluoromethyl sulfate, a sulfonate or the like of an alkali metal or an alkaline earth metal such as lithium, sodium, potassium, calcium, magnesium or the like; and so on. The amount of the ion conductive agent compounded is preferably within a range of 0.01-10 parts by mass, more preferably 0.05-5 parts by mass based on 100 parts by mass of the elastomer. The above conductive agents may be used alone or in a combination of two or more or in a combination of the electron conductive agent and the io conductive agent.

The elastic layer 3 is preferable to have a resistance value of $10^3$-$10^8$ Ωcm, more preferably $10^4$-$10^7$ Ωcm by compounding the above conductive agent. When the resistance value of the elastic layer 3 is less than $10^3$ Ωcm, electric charge may leak to the photosensitive drum or the like or the developing roller itself may be broken by a voltage, while when it exceeds $10^8$ Ωcm, the developing bias causes the voltage drop and hence the good image concentration may be not obtained or the fog may be easily caused.

The elastic layer 3 may contain a crosslinking agent such as an organic peroxide or the like, a vulcanizing agent such as sulfur or the like for rendering the elastomer into a rubbery substance, if necessary, and may further contain a vulcanization assistant, a vulcanization accelerator, an accelerator activator, a retarder and the like. Also, the elastic layer 3 may contain compounding ingredients for rubber such as a filler, a peptizer, a foaming agent, a plasticizer, a softening agent, a tackifier, an antitack agent, a parting agent, a releasing agent, an extender, a coloring agent and the like.

Further, the hardness of the elastic layer 3 is not particularly limited, but is preferably not more than 80 degrees, more preferably 40-70 degrees as an Asker C hardness. When the hardness exceeds 80 degrees, the contact area with the photosensitive drum or the like becomes small and there is a fear that the good image development can not be conducted. Furthermore, the toners are damaged or the fixation of the toners to the photosensitive body or stratification blade is caused to easily cause the image fault. On the other hand, when the hardness is too low, the friction force to the photosensitive body or stratification blade becomes large and there is a fear of causing the image fault such as jitter or the like. Since the elastic layer 3 is used in contact with the photosensitive body, stratification blade or the like, even when the hardness is set to a low level, it is desirable to make a compression set as small as possible. Concretely, the compression set is preferable to be not more than 20%.

As the resin forming the surface covering layer 4 in the developing roller according to the invention is used a crosslinking resin. The crosslinking resin is not particularly limited as far as it is a non-staining property to an image forming body such as photosensitive drum or the like and is not attached firmly thereto. The term "crosslinking resin" used herein means a resin self-crosslinking through heat, catalyst, air (oxygen), humidity (water), electron beam or the like, or a resin crosslinking by reaction with a crosslinking agent or another crosslinking resin. As the crosslinking resin are mentioned a fluorine resin, a polyamide resin, an acrylurethane resin, an alkyd resin, a phenolic resin, a melamine resin, a silicone resin, a polyurethane resin, a polyester resin, a polyvinylacetal resin, an epoxy resin, a polyether resin, an amino resin, a urea resin, an acrylic resin, an acryl-modified silicone resin, a sytrene-butadiene resin, which have, for example, a reactive group such as hydroxy group, carboxyl group, anhydride group, amino group, imino group, isocyanate group, methylol group, alkoxymethyl group, aldehyde group, mercapto group, epoxy group, unsaturated group or the like, and a mixture thereof. Also, they may be used in a mixture with the other resin. Among these crosslinking resins, polyurethane resin is preferable.

As the catalyst used for the crosslinking of these crosslinking resins are mentioned a radical catalyst such as peroxide, azo compound or the like, an acid catalyst, a basic catalyst and so on. Also, the crosslinking agent is a compound having in its molecule two or more reactive groups such as hydroxy group, carboxyl group, anhydride group, amino group, imino group, isocyanate group, methylol group, alkoxymethyl group, aldehyde group, mercapto group, epoxy group, unsaturated group or the like and a molecular weight of not more than 1000, preferably not more than 500, and includes, for example, a polyol compound, a polyisocyanate compound, a polyaldehyde compound, a polyamine compound, a polyepoxy compound and so on. Also, the surface covering layer may be further compounded with various additives such as a charge control agent, a lubricant, other resins and the like for the purpose of improving the charging characteristics to toners, reducing the friction force to the other member and giving the electric conductivity.

The surface covering layer 4 may be compounded with a conductive agent for the purpose of controlling the electric conductivity. As the conductive agent can be exemplified the same as described on the conductive agent used in elastic layer 3.

As the method of forming the surface covering layer 4 is preferably used a method wherein a paint containing components constituting the surface covering layer 4 is prepared and applied onto the elastic layer by a dipping process, a spraying process or a roll coating process and then dried. In the invention, it is preferable that the paint is left to stand at room temperature and normal humidity for not less than 24 hours and then applied onto the outer peripheral face of the elastic layer to from the surface covering layer 4. Thus, as the paint is left to stand at room temperature and normal humidity for not less than 24 hours, there can be obtained the developing roller with the surface having the above defined specular gloss, and also the toner feed quantity of the resulting developing roller can be made to a proper range. That is, according to the invention, it is sufficient that the paint containing the components constituting the surface cover layer 4 is prepared and left to stand at room temperature and normal humidity for not less than 24 hours and then applied onto the ouer peripheral face of the elastic layer.

As a solvent used in the preparation of the paint for forming the surface covering layer 4 is preferably used an alcohol solvent such as methanol, ethanol, isopropanol, butanol or the like; a ketone solvent such as acetone, methylethyl ketone, cyclohexane or the like; an aromatic hydrocarbon solvent such as toluene, xylene or the like; an aliphatic hydrocarbon solvent such as hexane or the like; an alicyclic hydrocarbon solvent such as cyclohexane or the like; an ester solvent such as ethyl acetate or the like; an ether solvent such as isopropyl ether, tetrahydrofuran or the like; an amide solvent such as dimethylsulfamide or the like; a halogenated hydrocarbon solvent such as chloroform, dichloroethane or the like; and a mixed solvent thereof. These solvents may be properly selected in accordance with the solubility of the resin used and are not particularly limited.

The thickness of the surface covering layer 4 is not particularly limited, but is preferably a range of 1-50 μm, more preferably a range of 2-30 μm. When the thickness of the surface covering layer 4 is less than 1 μn, local discharge occurs and white horizontal lines mat be easily caused in the image, while when it exceeds 50 μm, the surface of the developing roller becomes hard and hence the toners are damaged and the fixation of the toners to the photosensitive body or stratification blade may be caused to easily cause the image fault.

Figure 2:
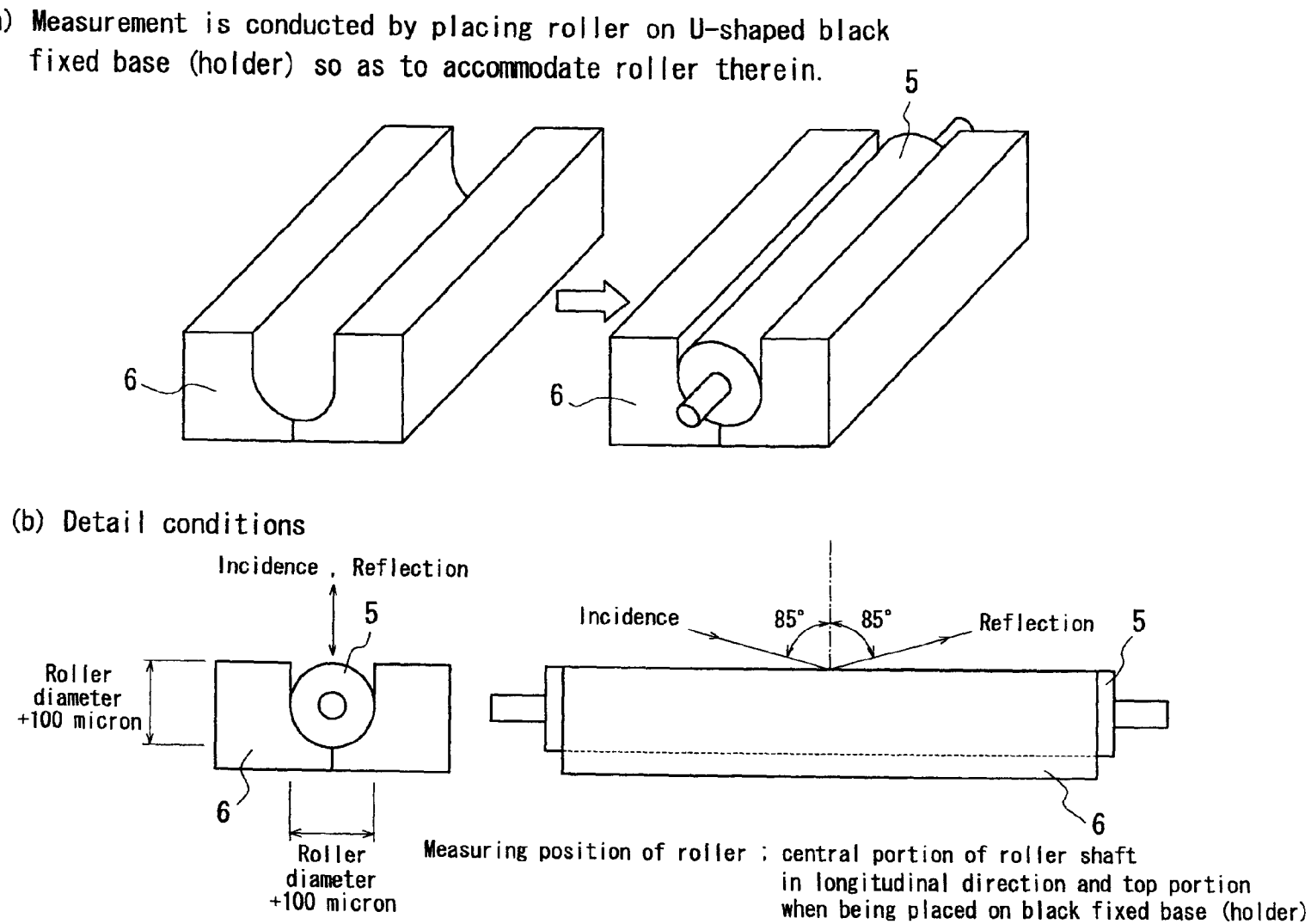
FIG. 2 is a schematic illustration of the inspection method of the developing roller according to an embodiment of the invention.

Furthermore, the inspection process for the developing roller according to the invention is characterized in that the surface of the developing roller is confirmed to have a specular gloss at 85° according to JIS Z8741 (Gs(85°)) of 14-55. The specular gloss is represented as a reflection index of 1.567 in a black glass standard plate according to DIN 67 530 is a specular gloss of 100. The specular gloss can be easily measured by means of a commercially available measuring meter. For example, the specular gloss can be directly measured without conversion by using a haze-gloss meter made by Big Gardner Company. FIG. 2 is a schematic illustration of the inspection method of the developing roller according to an embodiment of the invention. As shown in FIG. 2(*a*), a roller 5 is prepared to a length of 10 cm, and the resulting roller 5 is fixed to a black fixed base (holder) capable of fitting thereinto in accordance with the roller diameter, and an uppermost face of the roller is placed as a measuring face to a measuring port of the haze-gloss meter made by Big Gardner Company (not shown), and at this state a specular gloss of the roller 5 is measured at an incidental angle of 85° (measuring area: 8×60 mm). In this case, the measured value is obtained as the reflection index of 1.567 in a black glass standard plate according to DIN 67 530 is a specular gloss of 100 as mentioned above. Moreover, FIG. 2(*b*) explains detail conditions for the black fixed base 6 and the measurement of the specular gloss.

The following examples are given in illustration of the invention and are not intended as limitations thereof.

EXAMPLES 1-7 AND COMPARATIVE EXAMPLES 1-4

A base polymer having the following composition is mixed and added with a curing agent, and poured into a mold previously provided with a shaft 2 and then cured at 90° C. for 8 hours to form an elastic layer 3 on the outer periphery of the shaft 2. Then, the resulting roller is taken out from the mold and the surface thereof is polished to adjust JIS 10-point average roughness (Rz) to 8 μm.

Composition of Base Polymer

| | |
|---|---|
| Polyether polyol (trade name: EXCENOL 828) | 100 parts by mass |
| 1,4-butane diol | 5 parts by mass |
| Silicone surfactant (tade name: BY16-201) | 5 parts by mass |
| dibutyl dilaurate | 0.01 part by mass |
| acetylene black | 3 parts by mass |

Curing Agent urethane modified MDI (trade name: SMIDUL PF) 17.5 parts by mass

Then, a paint for the formation of a surface covering layer is prepared by mixing 100 parts by mass of urethane resin (trade name: DAIPLACOAT SO4748, made by Dainichiseika Color & Chemicals Mfg. Co., Ltd.), 10 parts by mass of an isocyanate curing agent (trade name: EN-2, made by Dainichiseika Color & Chemicals Mfg. Co., Ltd.) and 20 parts by mass of a silica filler (trade name: Nipsil SS-20, made by Nippon Silica Co., Ltd.) and left to stand at room temperature and normal humidity for a time shown in Table 1. Thereafter, the paint is diluted with a solvent shown in Table 1 so as to adjust a viscosity to a predetermined value. The resulting liquid is applied onto the elastic layer 3 by dipping to form a resin coating, which is cured at 110° C. for 4 hours to form a surface covering layer 4. In this way is prepared a developing roller of each of the examples and comparative examples.

With respect to the developing rollers of the examples and comparative examples are conducted the following tests for measuring properties. The results are shown in Table 1.

(1) Surface Roughness (Rz)

With respect to each roller, JIS 10-point average roughness is determined by measuring the surface roughness at 300 or more places with a surface roughness meter SURFCOM 590A (made by Tokyo Seimitsu Co., Ltd.) under conditions that a measuring length is 2.4 mm and a measuring rate is 0.3 mm/sec and a cutoff wavelength is 0.8 mm in a direction perpendicular to an axial direction without causing systematic error in the shaft direction and circumferential direction of the roller and averaging the measured values.

(2) Specular Gloss (Gs(85°))

With respect to each roller, the specular gloss at 85° is determined by measuring at 6 points of a top of the kept roller with Gardner-haze cross meter (made by BYK Gardner Co., Ltd.) according to JIS Z8741 (1997) and averaging the measured values.

(3) Roller Resistance

Each of the rollers is pushed onto a copper plate while applying a load of 500 g to each end of the roller and a voltage of 100 V is applied to measure a resistance value by means of a resistivity measuring meter R8340A (made by ADVANTEST Corporation).

(4) Toner Feed Quantity

Each of the rollers is mounted onto a developing unit and rotated at a peripheral speed of 50 mm/sec to form a uniform toner thin layer on the surface of the developing roller, and then the toner thin layer is sucked by a suction type small-size charge quantity measuring device Model 210HS-2A (made by TREC, INC) to measure an area of a sucked portion, from which a toner feed quantity per unit area is determined.

(5) Durable Test

The durable test of each roller is carried out by using a commercially available image forming apparatus as follows. The outer diameter of each roller is 20.00±0.05 mm, and the scale deflection of the outer diameter measured at a state of keeping the metal shaft is within 0.03 mm. As the toner is used a positive-charged, non-magnetic one-component polymer toner. A blade is made of silicone rubber. As a paper is used "BUSINESS MULTIPURPOSE 4200 PAPER" made by XEROX Co., Ltd. Characters are printed on the paper under a printing condition that the number of characters is adjusted to a predetermined occupation area % per the paper area. As the number of the printed papers, the upper limit is 14000 papers in case of 1% printing. As a standard for judging the image fog, the number of papers causing the fog is "X" at 0-8000 papers, "○" at 8001-11000 papers, and "◎" at 11001-14000 papers.

TABLE 1

| | | Example 1 | Example 2 | Example 3 | Example 4 | Example 5 | Example 6 | Example 7 |
|---|---|---|---|---|---|---|---|---|
| Time from preparation of paint to coating (hours) | | 110 | 96 | 48 | 24 | 72 | 4 | 24 |
| Viscosity (mPa/sec) | | 2.4 | 2.3 | 2.1 | 2.1 | 2.2 | 2 | 1.8 |
| Roller characteristics | Gloss Gs (85°) | 51.2 | 43.7 | 23.3 | 18.2 | 35.2 | 17.6 | 14.4 |
| | Surface roughness Rz (μm) | 4.9 | 5.5 | 4.8 | 5.1 | 5.2 | 5.5 | 4.6 |
| | Roller resistance (log Ω) | 8.1 | 8.3 | 8.3 | 8.1 | 8.1 | 8.4 | 8.1 |
| Durable test results | Black solid image | good | good | good | good | good | good | good |
| | Uneven image | good | good | good | good | good | good | good |
| | Toner feed quantity (mg/cm$^2$) | 0.19 | 0.18 | 0.19 | 0.19 | 0.20 | 0.20 | 0.24 |
| | Fog | ◎ | ○ | ○ | ○ | ◎ | ○ | ○ |

| | | Comparative Example 1 | Comparative Example 2 | Comparative Example 3 | Comparative Example 4 |
|---|---|---|---|---|---|
| Time from preparation of paint to coating (hours) | | 16 | 0 | 24 | 0 |
| Viscosity (mPa/sec) | | 2.1 | 2.4 | 1.7 | 2.1 |
| Roller characteristics | Gloss Gs (85°) | 12.8 | 9.9 | 17.2 | 8.5 |
| | Surface roughness Rz (μm) | 4.3 | 7.3 | 8.3 | 8.7 |
| | Roller resistance (log Ω) | 8.0 | 8.1 | 8.2 | 8.1 |
| Durable test results | Black solid image | good | good | good | good |
| | Uneven image | good | somewhat uneven | good | somewhat uneven |
| | Toner feed quantity (mg/cm$^2$) | 0.32 | 0.43 | 0.37 | 0.40 |
| | Fog | X | X | X | X |

As seen from Table 1, the developing roller of the examples according to the invention can stably form the good image because the toner feed quantity is within an adequate range.

What is claimed is:

1. A developing roller comprising a shaft, an elastic layer formed on an outer periphery of the shaft, and a surface covering layer formed on an outer peripheral face of the elastic layer, wherein a JIS 10-point average roughness (Rz) of the surface is 4-7 μm and a specular gloss at 85° according to JIS Z8741 of the surface is 14-55, and wherein the surface covering layer is formed by preparing a paint inclusive of a component constituting the surface covering layer, leaving at room temperature and normal humidity for not less than 24 hours and then applying the paint onto the outer peripheral face of the elastic layer.

2. A developing roller according to claim 1, wherein the elastic layer is made from polyurethane.

3. A developing roller according to claim 1, wherein the surface covering layer is made from a crosslinking resin.

4. A developing roller according to claim 3, wherein the crosslinking resin is a polyurethane resin.

5. A developing roller according to claim 1, wherein the JIS 10-point average roughness (Rz) of the surface is 4.6-4.9 μm.

6. A method of producing a developing roller comprising a shaft, an elastic layer formed on an outer periphery of the shaft, and a surface covering layer formed on an outer peripheral face of the elastic layer, wherein a JIS 10-point average roughness (Rz) of the surface is 4-7 μm and a specular gloss at 85° according to JIS Z8741 of the surface is 14-55, the method comprising:

preparing a paint inclusive of a component constituting a surface covering layer, and leaving the paint at room temperature and normal humidity for not less than 24 hours, and thereafter applying the paint onto an outer peripheral face of an elastic layer.

* * * * *